US006805594B2

(12) United States Patent
LaCoy

(10) Patent No.: US 6,805,594 B2
(45) Date of Patent: Oct. 19, 2004

(54) ELECTRICAL CONTACTS AND METHODS OF MANUFACTURE

(75) Inventor: Donald Richard LaCoy, Boylston, MA (US)

(73) Assignee: Smiths Group PLC, London (GB)

( * ) Notice: Subject to any disclaimer, the term of this patent is extended or adjusted under 35 U.S.C. 154(b) by 0 days.

(21) Appl. No.: 09/960,306

(22) Filed: Sep. 24, 2001

(65) Prior Publication Data

US 2002/0037674 A1 Mar. 28, 2002

(30) Foreign Application Priority Data

Sep. 22, 2000 (GB) ..... 0023290

(51) Int. Cl.[7] ..... H01R 11/22
(52) U.S. Cl. ..... 439/851
(58) Field of Search ..... 439/851, 852

(56) References Cited

U.S. PATENT DOCUMENTS 3,107,966 A * 10/1963 Bonhomme ..... 439/843
4,002,400 A * 1/1977 Evans ..... 439/748
4,203,647 A * 5/1980 Bonhomme ..... 439/851
4,720,157 A * 1/1988 Nestor et al. ..... 439/851
6,017,253 A * 1/2000 Schramme ..... 439/851

FOREIGN PATENT DOCUMENTS

GB 2 013 421 A 1/1979
SU 1354299 A1 11/1987

* cited by examiner

*Primary Examiner*—Tho D. Ta
*Assistant Examiner*—James R. Harvey
(74) *Attorney, Agent, or Firm*—Connolly Bove Lodge & Hutz LLP; Larry J. Hume

(57) ABSTRACT

An electrical socket has resilient wires extending together in a hyperboloid arrangement between retaining rings at opposite ends of the socket to which they are welded. The wires are grouped together in pairs and the pairs are spaced from one another around the socket. The socket is assembled by loading pairs of wires into respective slots extending along a mandrel.

8 Claims, 2 Drawing Sheets

(CONVENTIONAL)
Fig.2.
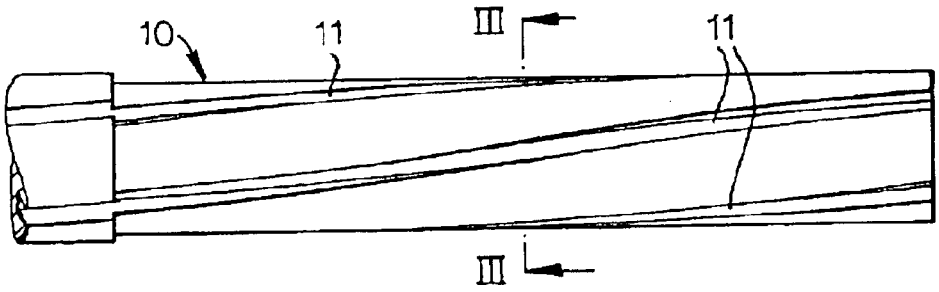
(CONVENTIONAL)
Fig.3.
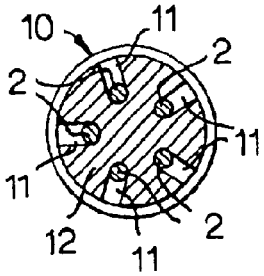
(CONVENTIONAL)

ELECTRICAL CONTACTS AND METHODS OF MANUFACTURE

BACKGROUND OF THE INVENTION

This invention relates to electrical contacts and methods of manufacture

The invention is more particularly concerned with hyperboloid socket contacts and their manufacture.

Hyperboloid socket contacts have a number of resilient wires extending longitudinally of the socket with opposite ends of the wires displaced with respect to one another through a small angle around the circumference of the socket so that the internal diameter of the passage through the wires midway along the length of the socket is reduced. This forms a resilient contact region for a male pin contact inserted in the socket. Opposite ends of the wires are welded to some form of retaining structure. Typically, a socket might have five wires equally spaced from one another around the circumference of the socket. The contacts are usually made by loading individual wires into respective slots in a cylindrical mandrel, the slots extending along the mandrel at an angle. The mandrel holds the wires in position while their ends are welded to some form of retaining structure. Contacts of this kind are described, for example, in U.S. Pat. Nos. 3,023,789, 3,107,966, 3,470,527, 3,557,428, and 5,203,813. Hyperboloid contacts are sold by Hypertac Limited of London, England, by Hypertronics Inc of Hudson, Mass., USA and by Interconnectron GmbH of Deggendorf, Germany.

Hyperboloid contacts have various advantages over other contacts in that they can have a low contact resistance, a low insertion force, a long effective life, they can carry high currents, they have an excellent wiping action and can be stable under shock and vibration.

BRIEF SUMMARY OF THE INVENTION

It is an object of the present invention to provide an alternative contact and method of manufacture.

According to one aspect of the present invention there is provided an electrical socket having a retaining structure and a plurality of resilient wires extending along the socket in a hyperboloid arrangement and exposed for contact with a male contact member inserted within the socket, the wires being arranged in groups of at least two wires each, and the spacing of the wires in each group being closer than that of the groups from one another.

The wires in each group preferably extend along the socket in contact with one another. The socket may include three groups of two wires each. The wires may be retained in groups by attachment to rings at opposite ends of the socket.

According to another aspect of the present invention there is provided a method of making an electrical socket comprising the steps of loading at least two spring wires into each of a plurality of slots in a mandrel, which slots extend along the mandrel at an angle to its axis, inserting the mandrel with the loaded wires into a retaining structure, attaching opposite ends of the wires to the retaining structure, and removing the mandrel to leave the wires extending along the socket in a hyperboloid arrangement.

The at least two wires are preferably loaded into the respective slots in the mandrel at the same time. The retaining structure may include a ring at opposite ends of the socket to which the wires are attached. The wires may be attached to the retaining structure by welding.

According to a further aspect of the present invention there is provided an electrical socket made by the method of the above other aspect of the invention.

A socket and its method of manufacture, according to the present invention, will now be described, by way of example, with reference to the accompanying drawings.

BRIEF DESCRIPTION OF THE DRAWINGS

FIG. 2 is a side elevation view of a conventional mandrel of the kind used in the manufacture of the socket in FIG. 1 but simplified to have only five wires;

FIG. 3 is a transverse section along the line III—III of FIG. 2;

DETAILED DESCRIPTION OF THE PREFERRED EMBODIMENT

Figure 1:
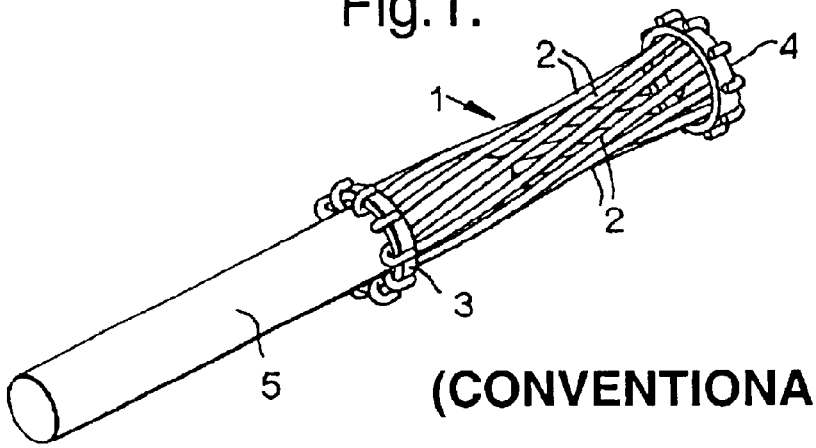
FIG. 1 is a perspective simplified view of a conventional socket having ten wires.

With reference first to FIG. 1, the conventional socket 1 has a number of resilient, metal wires 2 extending along the socket and equally spaced from one another around its circumference. The wires 2 are welded at their ends to respective rings 3 and 4 at opposite ends of the socket 1. The location at which one end of each wire 2 is attached to the forward ring 3 is displaced angularly around the socket from the location at which the opposite end of the wire is attached to the rear ring 4. In this way, the wires 2 have a hyperboloid configuration in which the passage along the socket between the wires reduces in diameter to a minimum midway along the length of the socket. The assembly of the wires 2 and rings 3 and 4 is mounted in a tubular housing (not shown) including some form of terminal to which electrical connection can be made. A male contact 5 inserted in the socket 1 from its forward end makes a sliding contact with the wires 2 in the central region of the socket.

With reference now also to FIGS. 2 and 3, there is shown a mandrel 10 used in manufacture of the socket 1. The drawing only shows a mandrel for a socket having five wires, for simplicity. The mandrel 10 is in the form of a solid rod of cylindrical shape and circular section. The mandrel has five slots 11 extending along its surface, the slots extending along the length of the mandrel and being inclined at an angle to its axis. The floor of each slot 11 is flat along its length but, because of the angle of the slots, the depth of each slot varies along the length of the mandrel 10, being a maximum midway along its length and reducing towards opposite ends. The depth of the slots 11 midway along the length of the mandrel 10 is such that the floor of the slots lie on a circle 12 in a transverse plane, the diameter of which is equal to the desired diameter of the passage between the wires 2 midway along the length of the socket. The width of each slot 11 is equal to the diameter of a wire 2.

A socket 1 is manufactured by loading five wires 2 into the mandrel 10, one in each slot 11. The wires 2 are straight and, therefore, lie flat on the floor of the slots 11. The mandrel 10 with the loaded wires 2 is then inserted through the rings 3 and 4 or other retaining structure and the wires are welded to the rings. The mandrel 10 is then removed leaving the wires 2 attached at their ends to the rings 3 and 4 and extending in a hyperboloid arrangement.

Figure 4:
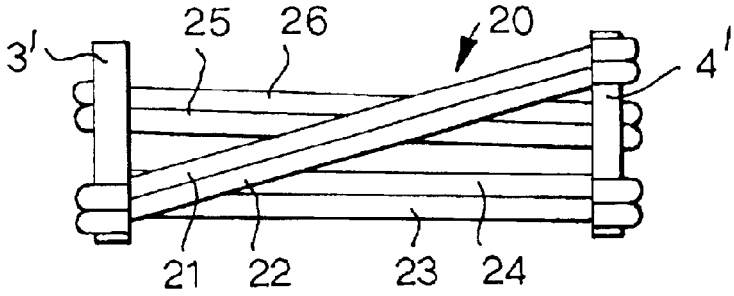
FIG. 4 is a side elevation view of a socket according to the present invention.

With reference to FIG. 4, there is shown a socket 20 according to the present invention. The socket 20 is substantially the same as that shown in FIG. 1 except that it has six wires 21 to 26 and that these are arranged in three groups of two wires each 21 and 22, 23 and 24 and 25, and 26. The wires 21 to 26 in each group extend side-by-side in contact with one another and the three groups of wires are spaced from one another equally around the circumference of the socket 20. The spacing between the groups of wires is, therefore, greater than the spacing of the two wires in each group.

Figure 5:
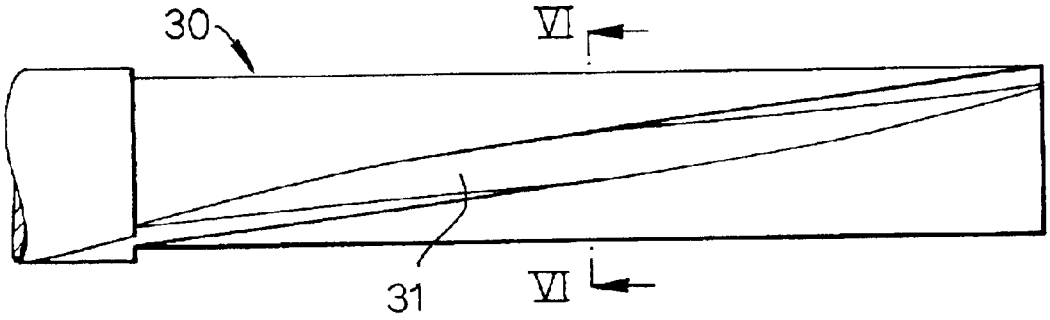
FIG. 5 is a side elevation view of a mandrel used to make the socket of FIG. 4.
Figure 6:
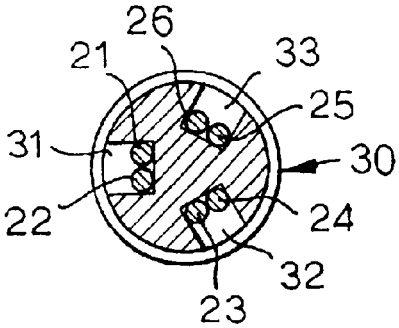
FIG. 6 is a transverse cross-section along the line VI—VI of FIG. 5.

The socket shown in FIG. 4 is made using the mandrel 30 shown in FIGS. 5 and 6. This mandrel 30 is the same as that shown in FIGS. 2 and 3 except that it has only three slots 31 to 33 and that the width of each slot is equal to twice the diameter of the wires 21 to 26. In this way, two wires 21 and 22, 23 and 24, and 25 and 26 are loaded side-by-side into each slot 31 to 33. Preferably, the two wires are loaded into each slot 31 to 33 at the same time. The wires 21 to 26 are welded to the rings 3' and 4' in the same way as conventionally.

This socket and method of manufacture have several advantages over conventional sockets and methods.

First, by loading more than one wire at a time into each socket, the loading cycle time is reduced. The cycle time for loading six wires by the present invention can be 40% less than that for loading five wires individually, in the conventional manner. The loading operation can also be more reliable where there are a reduced number of loading steps, as in the present invention. By grouping two or more wires together it is possible to manufacture a socket having a greater number of wires without increased manufacturing cost. This brings several advantages. For example, where six wires are used according to the present invention compared with five wires previously, the maximum current for the socket is increased by 20% and the contact resistance is reduced by 20%.

It will be appreciated that the invention is not confined to sockets and mandrels having groups of two wires each but could have three or more wires in each group. The number of groups could also be different from the three groups described.

I claim:

1. An electrical socket comprising:

a retaining structure and a plurality of wires extending along the socket in a hyperboloid arrangement suitably exposed for contact with a male contact member inserted within the socket, wherein said wires are arranged around a circumference of the socket in circumferentially adjacent groups of at least two wires each, wherein a circumferential spacing of said at least two wires in each circumferentially adjacent group is closer than a circumferential spacing between any adjacent pair of said circumferentially adjacent groups, wherein the circumferential spacing between said any adjacent pair of said circumferentially adjacent groups is free of any wires, and wherein each said wire of each said circumferentially adjacent group is arranged to make both direct physical and electrical contact with an outer surface of said male contact member when said male contact member is inserted within the socket.

2. An electrical socket according to claim 1, wherein said wires in each of said circumferentially adjacent groups extend along the socket in contact with one another.

3. An electrical socket according to claim 1, wherein the socket includes three circumferentially adjacent groups of two wires each.

4. An electrical socket according to claim 1, wherein said retaining structure includes a ring at each end of the socket, and wherein said wires are retained in groups by attachment to said rings at opposite ends of the socket.

5. An electrical socket according to claim 2, wherein the socket includes three groups of two wires each.

6. An electrical socket according to claim 2, wherein said retaining structure includes a ring at each end of the socket, and wherein said wires are retained in groups by attachment to said rings at opposite ends of the socket.

7. An electrical socket according to claim 3, wherein said retaining structure includes a ring at each end of the socket, and wherein said wires are retained in groups by attachment to said rings at opposite ends of the socket.

8. An electrical socket comprising:

a first support member at one end of the socket;

a second support member at an opposite end of the socket;

a first pair of resilient contact wires extending longitudinally along the socket at a first angle with respect to a longitudinal axis of the socket;

wherein corresponding wires are attached to said first and second support members at opposite ends of the socket;

a second pair of resilient contact wires extending longitudinally along the socket at a second angle with respect to the longitudinal axis of the socket;

said second pair of wires being circumferentially spaced around a circumference of the socket from a circumferential location of said first pair of wires on at least one of the first and second support members, and being attached with said first and second support members at opposite ends of the socket; and a third pair of resilient contact wires extending longitudinally along the socket at a third angle with respect to the longitudinal axis of the socket;

said third pair of wires being circumferentially spaced around the circumference of the socket from said first and second pairs, and being attached with said first and second support members at opposite ends of the socket such that the first, second, and third pairs of resilient contact wires from a hyperboloid arrangement and are suitably exposed for both direct physical and electrical contact with a male contact member inserted within the socket, wherein a circumferential spacing around the circumference of the socket between adjacent wires in each of the first and second pairs of wires is less than a circumferential spacing around the circumference of the socket between each of the three pairs of wires, and wherein the circumferential spacing around the circumference of the socket between any circumferentially adjacent pair of wires is free of any wires.

* * * * *